US009038726B2

(12) United States Patent
Christie et al.

(10) Patent No.: US 9,038,726 B2
(45) Date of Patent: May 26, 2015

(54) LIGHT WELL INTERVENTION UMBILICAL AND FLYING LEAD MANAGEMENT SYSTEM AND RELATED METHODS

(75) Inventors: David Stewart Christie, Scotland (GB); Michael Marr, Lagos (NG); Ian Calder, Aberdeen (GB); Steven Salman, Perth (AU)

(73) Assignee: Vetco Gray U.K., Limited, Aberdeen (GB)

( * ) Notice: Subject to any disclaimer, the term of this patent is extended or adjusted under 35 U.S.C. 154(b) by 326 days.

(21) Appl. No.: 13/494,799

(22) Filed: Jun. 12, 2012

(65) Prior Publication Data

US 2013/0327534 A1 Dec. 12, 2013

(51) Int. Cl.

| | |
|---|---|
| ***E21B 43/01*** | (2006.01) |
| ***E21B 33/035*** | (2006.01) |
| ***E21B 33/076*** | (2006.01) |

(52) U.S. Cl.

CPC ..... *E21B 33/0355* (2013.01); *E21B 33/076* (2013.01)

(58) Field of Classification Search

CPC ..... E21B 33/0355; E21B 33/076
USPC ..... 166/338, 344, 346, 349, 352, 85.1; 405/190, 191, 158, 200
See application file for complete search history.

(56) References Cited

U.S. PATENT DOCUMENTS

| | | | | |
|---|---|---|---|---|
| 4,570,716 | A * | 2/1986 | Genini et al. | 166/346 |
| 6,102,124 | A * | 8/2000 | Skeels et al. | 166/347 |
| 6,223,675 | B1 * | 5/2001 | Watt et al. | 114/312 |
| 6,612,369 | B1 * | 9/2003 | Rocha et al. | 166/363 |
| 7,331,394 | B2 * | 2/2008 | Edwards et al. | 166/339 |
| 2008/0308277 | A1 * | 12/2008 | Dursley | 166/338 |

FOREIGN PATENT DOCUMENTS

| | | | | |
|---|---|---|---|---|
| GB | 2178128 | A * | 2/1987 | F16L 1/04 |
| WO | 0121479 | A1 | 3/2001 | |
| WO | 2010019675 | A2 | 2/2010 | |

OTHER PUBLICATIONS

Brochure—"Riser Light Well Intervention System", FMC Technologies (Copyrighted 2012, downloaded Sep. 13, 2012).

PCT Search Report and Written Opinion issued in connection with corresponding Application No. PCT/EP2013/062193 on Jul. 25, 2014.

* cited by examiner

*Primary Examiner* — James G Sayre
(74) *Attorney, Agent, or Firm* — Bracewell & Giuliani LLP

(57) ABSTRACT

Systems and methods for managing umbilical lines and one or more jumpers are provided. An example of a system includes a deployment platform carrying a winch and spool assembly, a tether management assembly, and an integrated electrical and/or hydraulic umbilical line extending between a spool on the winch and spool assembly and the tether management assembly. The winch and spool assembly is configured to deploy and to support the umbilical line. The tether management assembly includes a winch and spool assembly for deploying a flying lead and/or annulus jumper adapted to connect to an emergency disconnect package of a well control package for a well. A set of buoyant modules are connected to or integral with a portion of the umbilical line to be used to form an artificial heave compensation loop.

22 Claims, 6 Drawing Sheets

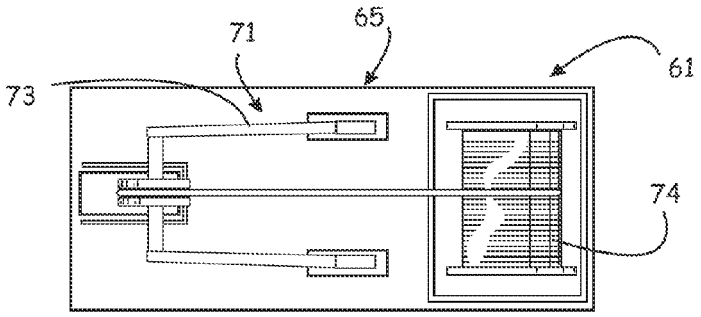
FIG. 3A.
FIG. 3B.
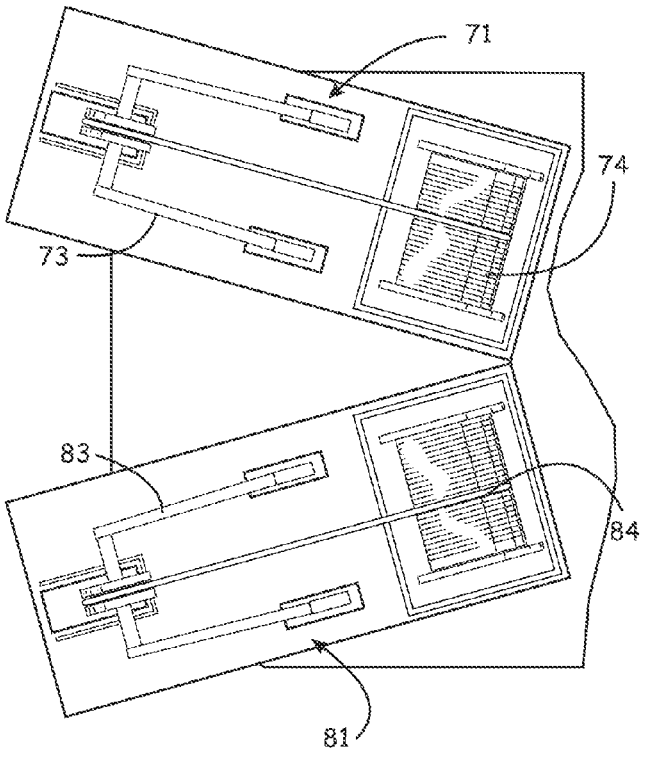

LIGHT WELL INTERVENTION UMBILICAL AND FLYING LEAD MANAGEMENT SYSTEM AND RELATED METHODS

BACKGROUND OF THE INVENTION

1. Field of the Invention

This invention relates to a well intervention systems and methods of providing a control, chemical injection, and/or kill system for light well intervention, in general, and providing systems and methods which employ a remote connection point for control, chemical injection, and/or kill system umbilicals that is remote from the wellhead, in particular.

2. Description of the Related Art

Intervention in a subsea well may be required to provide repair, inspection/diagnostics, maintenance, on the well, to provide for improvements in order to increase production, or to and production. Light well intervention is generally considered to be defined, at least in part, as an intervention operation which does not need a drilling rig to provide access to the well.

A subsea well system such as a water injection well or a producing well does not normally have a drilling rig positioned above it or a riser assembly extending between the subsea well and drilling rig or other surface vessel that can provide a conduit for performing maintenance and/or intervention operations.

A typical water injection well includes a tubing spool assembly, a tubing hanger assembly, a water injection tree assembly landing atop and connected to the tubing spool assembly, a lower riser package landing atop and connected to the water injection tree assembly, an emergency disconnect package landing atop and connected to the water injection tree assembly, a riser stress joint landing atop and connected to the emergency disconnect package, a riser crossover landing atop and connected to the riser stress joint, and a pressure control head landing atop and connected to the riser crossover.

The normal procedure in subsea light well intervention for such type of well is to position a vessel of convenience, for example, a large supply boat (e.g., repair/inspection/maintenance vessel), or a specially designed light well intervention vessel or rig above the wellhead assembly. A wireline work tool, which can be a "dumb" tool or electric powered, is extended either through the moon pool of the vessel or over the side of the vessel typically via a crane-type device. The wireline tool connects to and extends through the pressure control head. The procedure also includes running electrical and/or hydraulic umbilicals and/or annulus umbilicals such as, for example, kill and chemical injection lines, from a heave compensating winch also located on the vessel adjacent the moon pool or crane location. These umbilicals are typically deployed by directly attaching them to the emergency disconnect package, which places them in close proximity of the wireline of the wireline tool. Guidelines are then utilized to separate the umbilicals from the wireline to prevent fouling or damage to the umbilicals. As such, this form of umbilical deployment system has been recognized by the inventors to be vulnerable and inefficient.

Accordingly, recognized by the inventors is the need for a system and methods for performing a light well intervention which can reduce congestion adjacent the moon pool/deployment location; which can maximize the distance between the umbilicals and the wireline to avoid damaging the umbilical and/or wireline, particularly in environments with high currents or offsets; which does not require the deployment and installation of guidelines to prevent umbilical entanglement; which can allow for smaller vessels to be used; and which can maximize its operating window of the vessel, thereby also reducing the cost of the intervention.

Also recognized is the need for a system and method for performing a light well intervention which does not require a heave compensation capability on the umbilical winch; which allows the umbilicals to be deployed sufficiently far from the vessel's hull so that in adverse weather conditions the umbilicals can be prevented from being damaged as a result of contacting the hull; and which allows for easy reconnection of the control lines to reestablish surface control in the event of an emergency disconnect and/or third-party access in the event of a lost vessel.

SUMMARY OF THE INVENTION

In view of the foregoing, various embodiments of the present invention advantageously provide systems and methods for managing umbilical lines and flying leads and providing control, chemical injection, and/or a well kill capability for/during a light well intervention. Various embodiments of the system and methods can advantageously reduce congestion adjacent the moon pool/deployment location, and maximize the distance between the umbilicals and the wireline using available space on the vessel to avoid damaging the umbilical and/or wireline, particularly in environments with high currents or offsets. Various embodiments allow for smaller (e.g., IMR) vessels to be used through the use of offset deployment positioning on the vessel, and correspondingly, do not require the deployment and installation of guidelines to prevent umbilical entanglement. Various embodiments can advantageously reduce the cost of the intervention through use of offset deployment positioning and positive buoyancy of portions of the umbilicals.

Various embodiments advantageously can also provide systems and methods which provide a seabed mooring system (for connecting the umbilicals) positioned separate from the wellhead and a heave compensation loop created in the umbilicals just above the mooring. The heave compensation loop can passively absorb vessel heave, negating a need for expensive heave compensation on the umbilical winches.

Various embodiments advantageously can also provide systems and methods which include positioning the lines between the surface on the seabed in discrete positions to suit operations and to allow the vessel to weathervane, maximizing the operating window of the vessel and thus, also reduce the cost of the intervention.

Various embodiments advantageously can also provide systems and methods which allow the umbilicals to be deployed sufficiently far from the vessel's hull so that in adverse weather conditions the umbilicals can be prevented from damage when contacting the hull; and which allows for easy reconnection of the control lines to reestablish surface control in the event of an emergency disconnect and/or third-party access in the event of a lost vessel.

Various embodiments advantageously can further provide systems and methods to manage control lines, well kill lines, and chemical injection through an improved umbilicals/kill line deployment system. The improved deployment system can include a remotely positioned tether management system (or termination assembly) that provides a remote connection of the umbilicals/kill line separate and spaced apart from the wellhead, and that supports a flying lead management system or assembly which connects the termination assembly to the wellhead. According to one or more embodiments, the tether management system provides separate mooring point for the control umbilical's/chemical/kill injection lines, which is run to or adjacent the sea floor to provide a remote connection point and crossover to seabed umbilical's and injection lines. According to various embodiments stab-type connectors and/or breakaway plates can be utilized to connect the umbilicals deployed from the vessel to the termination assembly to allow for a quick disconnect and re-connection/third-party access.

Various embodiments advantageously provide a control/chemical injection/kill system for light well intervention that can be installed on a subsea well from a vessel of convenience. Various embodiments of the present invention also provide an umbilical, flying lead (UFL), kill and chemical injection line management system designed to act as a clump weight and flying lead deployment system for light well intervention. Current light well intervention systems are handicapped by having vulnerable and inefficient umbilical deployment systems. One or more embodiments of the invention provide an umbilical deployment system comprising a single skid-mounted unit which includes umbilical reel, A-frame over boarding sheave, clump weight and flying lead management system. This single skid mounted unit can be mobilized either for permanent installation on a vessel or as a temporarily sea fastened unit as required. By having the unit skid mounted and incorporating the flying line/lead management system, mobilization and installation time can be significantly reduced.

More specifically, according to an example of an embodiment of a method for providing control and well kill capability during a subsea light well intervention, the method can include the steps of connecting a sea-bound end of an umbilical line to a tether management assembly, and running the umbilical line from an umbilical spool assembly located on a vessel and carrying the umbilical line. The tether management assembly can include a variable weight mud mat configured to stabilize the tether management assembly according to local environmental conditions. The tether management assembly can also or alternatively include a connector for operably coupling the sea-bound end of the umbilical line to a jumper, and a jumper spool assembly carrying the jumper. As such, the steps can also include connecting an end of the jumper to a connector located on a well package of a subsea well to include paying out a sufficient amount of the jumper to reach the connector located on the well package, and landing the tether management assembly on or adjacent a seabed at a location substantially spaced apart from a location of the subsea well.

According to an embodiment, the sea-bound end the umbilical line is connected to the tether management assembly prior to running the tether management assembly or landing the tether management assembly on or adjacent the seabed. Correspondingly, the step of running the umbilical line from the umbilical spool assembly and landing the tether management assembly are performed together. The umbilical spool assembly can carry the weight of both the tether management assembly and deployed portion of the umbilical line not otherwise being compensated for. The umbilical spool assembly, located on the vessel, is carried by a skid-mounted deployment assembly, mounted on a single skid to reduce mobilization and installation time, and the umbilical spool assembly is substantially spaced apart from a winch or crane assembly performing the step of running a wireline work tool through a pressure control head connected to the well package of the subsea well.

According to an embodiment, a set of buoyant modules are connected to or integral with the umbilical line, with each of the set of buoyant modules positioned adjacent to at least one other buoyant module of the set of buoyant modules. When the tether management assembly is landed on or adjacent the seabed, the set of buoyant modules can at least substantially entirely support the weight of the portion of the umbilical line extending between the set of buoyant modules and the sea-bound end of the umbilical line connected to the tether management assembly not otherwise compensated for by any natural buoyancy of the umbilical. In order to form a heave compensation loop, the steps can include paying out additional umbilical line so that a substantial portion of the umbilical line sags substantially below a water level of the set of buoyant modules at its normal level. In such state, the set of buoyant modules at least partially supports the weight of the sagging portion of the umbilical line extending between the set of buoyant modules and the umbilical spool assembly, and the umbilical spool assembly supports the portion of the weight of the sagging portion of the umbilical line not supported by the set of buoyant modules. According to an exemplary configuration, under steady-state conditions, the formed heave compensation loop measures between approximately 25 m and 100 m in umbilical line length, with 50 m being more typical depending upon conditions.

According to an exemplary embodiment, the desired length of the heave compensation loop is determined through a study identifying an anticipated amount of movement of a reference point on the vessel in relation to the set of buoyant modules to determine an amount of slack needed to compensate for heave. Notably, when properly configured, the heave compensation loop negates the need for any form of heave compensator on the umbilical spool. As such, the exemplary configuration of the umbilical spool assembly does not include a heave compensator.

In the exemplary configuration, the umbilical line is a first umbilical line, the jumper is a first jumper defining a flying lead, the connector is a first connector, and the tether management assembly further includes a second connector for operably coupling the sea-bound end of a second umbilical line to an annulus jumper including a plurality of buoyancy modules, and a jumper spool assembly carrying the annulus jumper. As such, the steps can also include connecting an end of the annulus jumper to a connector located on the well package of the subsea well, paying out a sufficient amount of the annulus jumper to reach the second connector located on the well package.

Another embodiment of a method for providing control and well kill capability during a subsea light well intervention, can include the steps of connecting a sea-bound end of an umbilical line to a tether management assembly including a connector for operably coupling a crossover line to the sea-bound end of the umbilical line, and a flying leap spool assembly carrying a flying lead operably coupled with the crossover line. In an exemplary configuration, the umbilical line is an integrated electrical and hydraulic line. The steps can also include running the umbilical line from an umbilical spool assembly carrying the umbilical line, located on a vessel. The steps can also include connecting an end of the flying lead to a connector located on an emergency disconnect package of a subsea well, paying out a sufficient amount of the flying lead to reach the connector located on the emergency disconnect package utilizing a remote operated vehicle, and landing the tether management assembly on or adjacent a seabed at a location substantially spaced apart from a location of the subsea well.

According to an exemplary configuration, a set of buoyant modules are connected to or integral with the umbilical line, with each of the set of buoyant modules positioned adjacent to at least one other buoyant module of the set of buoyant modules. When the tether management assembly is landed on or adjacent the seabed, the set of buoyant modules at least substantially entirely support the weight of the portion of the umbilical line extending between the set of buoyant modules and the sea-bound end of the umbilical line connected to the tether management assembly. In order to form a heave compensation loop, the steps can include paying out additional umbilical line so that a substantial portion of the umbilical line sags substantially below a water level of the set of buoyant modules at its normal level. In such state, the set of buoyant modules at least partially supports the weight of the sagging portion of the umbilical line extending between the set of buoyant modules and the umbilical spool assembly, and the umbilical spool assembly supports the portion of the weight of the sagging portion of the umbilical line not supported by the set of buoyant modules.

Similar to the prior described embodiment, in the exemplary configuration of this embodiment, the umbilical line is a first umbilical line, the jumper is a first jumper defining a flying lead, the connector is a first connector, and the tether management assembly further includes a second connector for operably coupling the sea-bound end of a second umbilical line to an annulus jumper including a plurality of buoyancy modules, and a jumper spool assembly carrying the annulus jumper. As such, the steps can also include connecting an end of the annulus jumper to a connector located on the well package of the subsea well, paying out a sufficient amount of the annulus jumper to reach the second connector located on the well package.

Systems for providing control and well kill capability during a subsea light well intervention, is also provided. The system can include a tether management assembly landed on or adjacent a seabed at a location substantially spaced apart from a location of a subsea well. The tether management assembly includes a connector for operably coupling a crossover line to a sea-bound end of an umbilical line, a flying lead operably coupled with the crossover line and adapted to connect to an emergency disconnect package of a well control package for the subsea well, and a flying lead spool assembly for deploying the flying lead. The tether management assembly can include a variable weight mud mat to stabilize the assembly according to local environmental conditions.

The system also includes an umbilical spool assembly located on a vessel. The umbilical spool assembly is configured to deploy and can be configured to support the weight of the umbilical line and the tether management assembly during deployment thereof when connected thereto. According to an exemplary configuration, the umbilical spool assembly located on the vessel is carried by a skid-mounted deployment assembly, mounted on a single skid to reduce mobilization and installation time. When operationally employed, the umbilical line extends between the tether management assembly which is landed on or adjacent the seabed and the umbilical spool located on the vessel. According to such positioning, the umbilical line is substantially spaced apart from a wireline tool run from the vessel to perform a light well intervention to prevent entanglement.

According to an exemplary configuration, a set of buoyant modules connected to or integral with a portion of the umbilical line can be used to form an artificial heave compensation loop, with the artificial heave compensation loop, typically on the order of 25 m to 100 m in length, being defined by a substantial portion of the umbilical line sagging below a water level of the set of buoyant modules. The set of buoyant modules are positioned to at least partially support the weight of the portion of the umbilical line extending between the set of buoyant modules and the umbilical spool assembly that is sagging below the water level of the set of buoyant modules when at its nominal level, with the umbilical spool assembly supporting the portion of the weight of the sagging portion of the umbilical line not supported by the set of buoyant modules. According to this configuration, the artificial heave compensation loop is sufficient to negate the need for a heave compensator on the umbilical spool assembly, reducing the cost of the assembly.

According to an exemplary configuration, the umbilical line comprises an integrated electrical and hydraulic line. According to an embodiment, the system can also include an annulus umbilical line extending between an annulus umbilical spool assembly and either the above described tether management assembly or a separate tether management assembly positioned adjacent thereto. Regardless, the respective tether management assembly can include an annulus jumper spool configured to pass out an annulus jumper to connect to the emergency disconnect package. The annulus jumper integral with or otherwise operably coupled with a plurality of buoyant modules to provide separation between the annulus jumper in the flying lead.

According to another embodiment of a system for providing control and well kill capability during a subsea light well intervention, the system can include a tether management assembly landed on or adjacent a seabed at a location substantially spaced apart from a location of a subsea well. The tether management assembly can itself include a jumper adapted to connect to a connector located on a well control package for the subsea well, a jumper spool assembly for deploying the jumper, and a connector for operably coupling a sea-bound end of an umbilical line to the jumper. The system can also include an umbilical spool assembly located on a vessel and configured to deploy an umbilical line, itself configured to connect between the tether management assembly when landed on or adjacent the seabed and the umbilical spool when located on the vessel.

According to such exemplary configuration, a set of buoyant modules connected to or integral with a portion of the umbilical line can be used, in conjunction with the umbilical line, to form an artificial heave compensation loop being defined by a substantial portion of the umbilical line sagging below a water level of the set of buoyant modules when operationally deployed with the umbilical line. The set of buoyant modules are positioned to at least partially support the weight of the portion of the umbilical line extending between the set of buoyant modules and the umbilical spool assembly, sagging substantially below the water level of the set of buoyant modules when at its nominal level. As described in the previous embodiment, the umbilical spool assembly can support the portion of the weight of the sagging portion of the umbilical line not supported by the set of buoyant modules to provide the necessary support structure to form the artificial heave compensation loop.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

FIG. 3A is a plan view of a deployment assembly according to an embodiment of the present invention;

FIG. 3B is a plan view of a deployment assembly according to an embodiment of the present invention;

DETAILED DESCRIPTION

The present invention will now be described more fully hereinafter with reference to the accompanying drawings, which illustrate various embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

Figure 1:
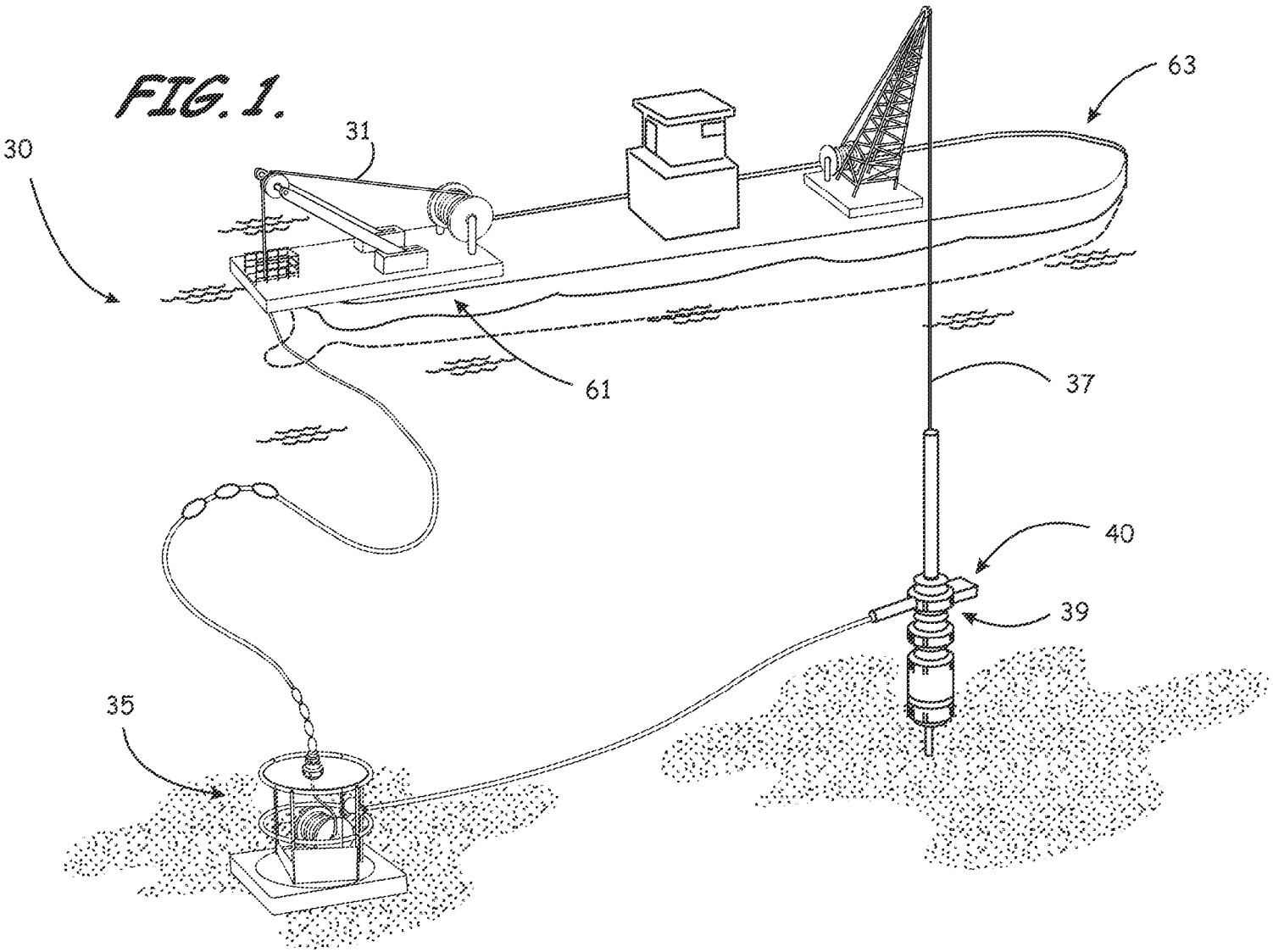
FIG. 1 is a schematic diagram of a general system architecture of a control/chemical injection/kill system for light well subsea intervention according to an embodiment of the present invention.

Referring to FIG. 1, various embodiments of the present invention provide a system 30 for managing umbilical lines and flying leads and providing control, chemical injection, and/or well kill for a light well subsea intervention, that allows seamless control of both riser or riserless well control packages. The system 30 combines a downline umbilical 31 or umbilicals 31, 32 (FIG. 2B) with a retractable flying lead 33, through use of a tether management system or assembly 35 (or termination assembly) to form an integrated umbilical and flying lead (UFL) system or assembly. As will be described in more detail below, this methodology and configuration provides several benefits. For example, this methodology and configuration can beneficially allow the distance between the umbilicals 31, 32 and the wire line 37 to be maximized in order to avoid damaging the umbilicals/wireline in high currents/offsets. Further, according to such methodology and configuration, due to such offset, guidelines (not shown) are not required to prevent umbilical entanglement with the wireline equipment. Also, because the umbilicals 31, 32 are not being connected directly to the emergency shut down or emergency disconnect package (EDP) 39 or other components of the well control package of the subsea well 40, the methodology and configuration can reduce congestion adjacent the wireline moon pool or other wireline deployment location.

Figure 2B:
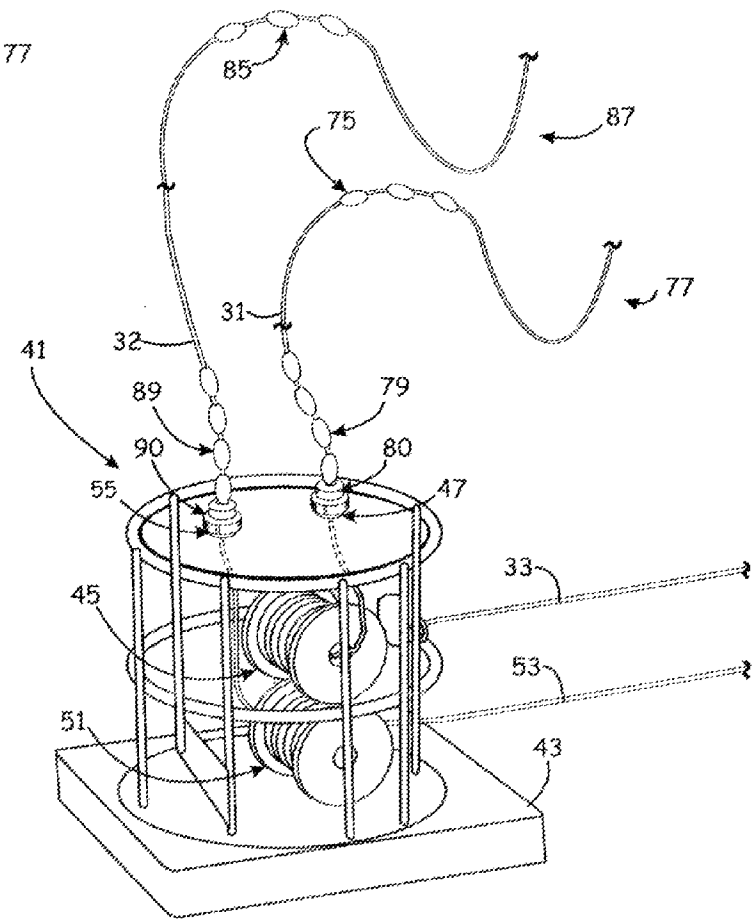
FIG. 2B is a schematic view of a tether management assembly according to an embodiment of the present invention.
Figure 2A:
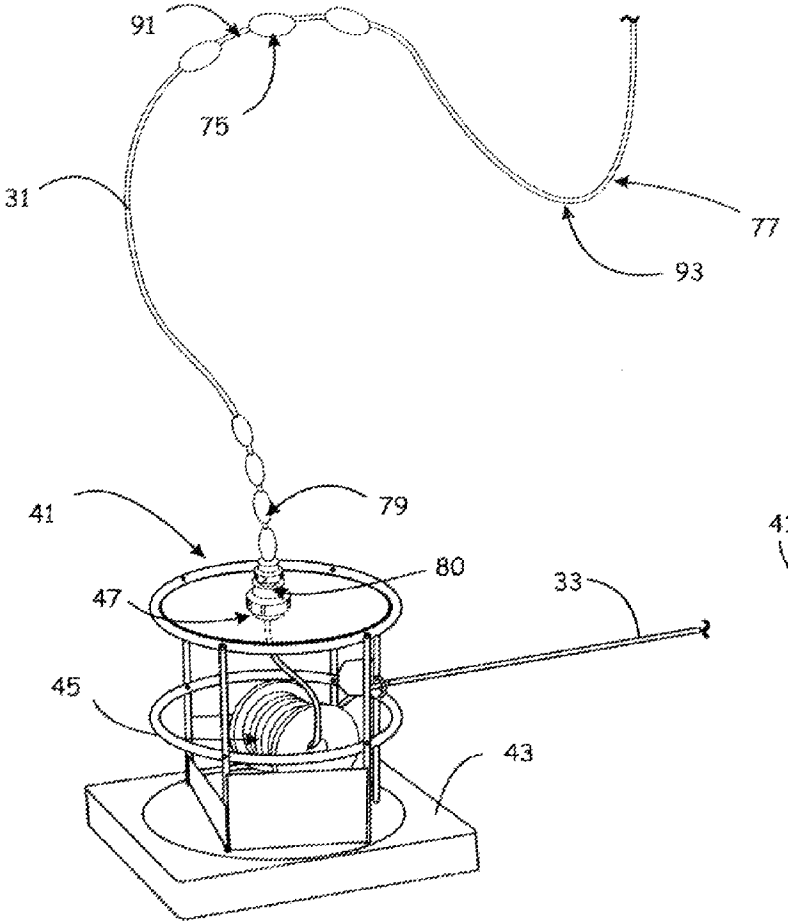
FIG. 2A is a schematic view of a tether management assembly according to an embodiment of the present invention.

Referring to FIG. 2A, the tether management assembly 35 can include frame 41 specifically designed or otherwise capable of containing various opponents thereof. The frame 41 allows are the remotely connect and disconnect the seabed ends of the umbilicals 31, 32. The assembly 35 can also include a variable weight mud mat 43 functioning as a clump weight, a flying lead spool assembly 45 (e.g., winch and spool) carrying the flying lead 33, and a breakaway plate/quick disconnect system/assembly 47 for releasably connecting an end of a first umbilical 31 (typically containing electrical or hydraulic conduits). Note, according to the exemplary configuration, the tether management assembly 35, when combined with the variable-rate mud mat/clump weight 43, enables the umbilical 31 and flying lead 33 to be deployed in a single lift.

The full hook up of the subsea light well intervention control and kill system can be effected in a single deployment and a single ROV connection. This can have the effect of making the intervention more efficient and user friendly, and thus, reduce deployment related activities and save time. The umbilical termination at the tether management assembly 35 has a quick disconnect capability in the event of a vessel drive off. The quick disconnect 47 can be reconnected by using an ROV.

Referring to FIG. 2B, the tether management assembly 35 can also or optionally include an annulus hose jumper spool assembly 51 (e.g., winch and spool) carrying an annulus hose jumper 53, and breakaway plate/quick disconnect system or assembly 55 for releasably connecting a second umbilical 32 (typically containing a conduit for carrying chemicals for providing chemical injection). This too can be part of the single lift. Note, in an alternative embodiment, a second tether management assembly (not shown) similar to tether management assembly 35 can be separately deployed alongside the first tether management assembly 35 shown in FIG. 2A, to separately carry the annulus hose jumper 53.

The tether management assembly 35 can be stored and pre commissioned on the skid base 65 (FIG. 3A) for shipment or when not in use. This can beneficially keep the amount of required deck space to a minimum and facilitates hook up.

Figure 4:
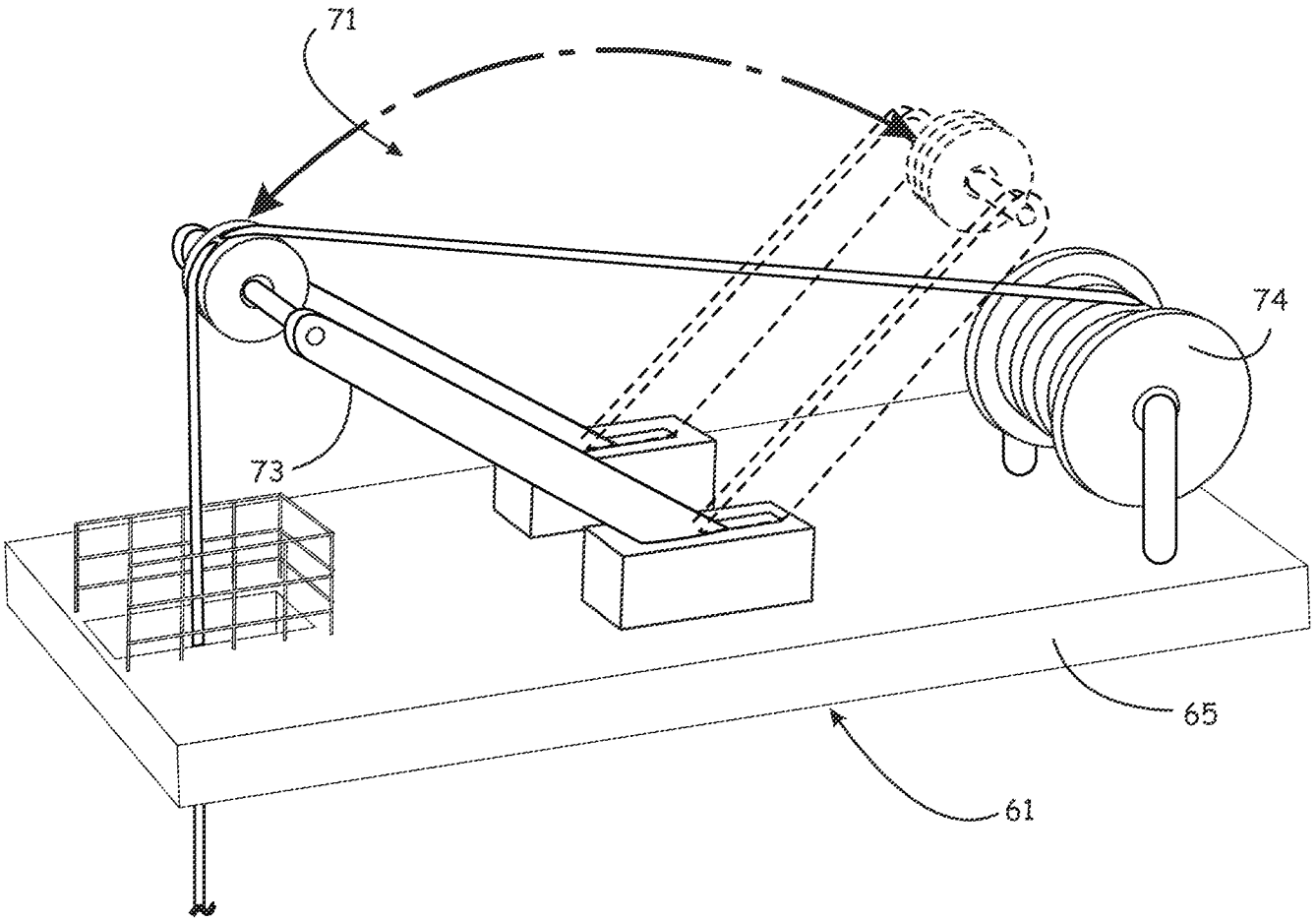
FIG. 4 is a perspective of a deployment assembly according to an embodiment of the present invention.

Referring to FIGS. 1, 3A and 4, the system 30 can include an integrated "over the side" deployment A-frame assembly 61 that can deploy over a vessel's bulwark, the tether management assembly 35 containing the flying lead spool assembly 45 and the accompanying flying lead 33 and/or the annulus hose jumper spool assembly 51 carrying the annulus hose jumper 53. According to the exemplary configuration, the full assembly 61 is skid mounted to enable the complete assembly 61 to be loaded in a single lift onto a vessel 63 of convenience, such as, for example, a large supply boat (repair/inspection/maintenance vessel), a custom-designed light well intervention vessel, or a rig.

The assembly 61 includes an electrical-hydraulic umbilical winch and spool assembly 71 including a retractable winch arm 73 connected to a skid base 65 and spool 74 carrying an electrical-hydraulic umbilical 31 also connected to the skid base 65. The umbilical 31 can contain electrical, hydraulic, flushing and well kill lines form a single integrated umbilical line. The umbilical 31 can also include a set of buoyant modules 75 connected to or integral with a portion of the umbilical 31 to be used to form an artificial heave compensation loop 77 (described in more detail later). The umbilical 31 can also include a bend restrictor 79 on the seaward end of the umbilical 31 to prevent bending when connected to a deployed tether management assembly 35. The umbilical 31 can also include a MOFAT or other type of, e.g., stabbing connector 80 on the seaward end.

Referring also to FIG. 3B, the assembly 61 can also include a second winch and spool assembly 81 including a retractable winch arm 83 connected to the skid base 65 and spool 84 carrying an optional annulus umbilical 32 also connected to the skid base 65. The umbilical 32 can contain chemical injection lines to form a single integrated umbilical line. The umbilical 31 can also include a set of buoyant modules 85 connected to or integral with a portion of the umbilical 32 to be used to form an artificial heave compensation loop 87 (described in more detail later). Similar to the umbilical 31, the umbilical 32 can also include a bend restrictor 89 on the seaward end of the umbilical 32 to prevent bending when connected to a deployed tether management assembly 35. The umbilical 32 can also include a MOFAT or other type of, e.g., stabbing connector 90 on the seaward end.

Beneficially, the above described methodology and configuration can allow each umbilical 31, 32 (collectively referred to as umbilicals 31) to be deployed sufficiently far enough from the vessel's hull so that in adverse weather conditions the umbilicals 31, 32, can be prevented from damage when contacting the hull.

Referring again to FIG. 1, the surface down umbilicals 31, 32, and other well control lines can be streamed from the vessel 63 such that the vessel 63 can weathervane and remain out of the well re-entry envelop where, due to currents etc., the various lines may get entangled or damaged. Beneficially, as a result of positioning and mooring of the umbilicals 31 and/or 32 with the tether management assembly 35, the vessel 63 can weathervane, and thus, maximize its operating window.

According to the exemplary configuration, the umbilical 31 is designed to support its own weight and can potentially support the entire weight of the tether management assembly 35 including the flying lead spool assembly 45 carrying the flying lead 33 and mud mat 43, for the full operating depth. Similarly, the umbilical 32 is designed to support its own weight and can potentially support the entire weight of the tether management assembly 35 including the annulus hose jumper spool assembly 51 carrying an annulus hose jumper 53 and mud mat 43. Additionally, each umbilical winch and spool assembly 71, 81, can support the full weight of the respective umbilical 31, 32, when deployed with the tether management assembly 35 including one or both of the spool assemblies 45, 51, and mud mat 43. According to one or more embodiments, the umbilical winch and spool assembly 71, 81 is capable of being put into self-tensioning mode to a nominal tension above deployed weight. According to one or more embodiments, the mud mat 43 option provides stability for the tether management assembly 35, and thus, stability to the flying lead winch and spool assembly 45 and provides an anchor in the event of high currents.

The well control package of the subsea well 40 has an emergency shutdown/quick disconnect function to allow remote disconnection of a workover riser system. In the light well intervention systems, however, without a riser, this function is rerouted from the emergency quick disconnect package to the remote makeups for the surface umbilicals and chemical/kill injection lines such that, in the event of a vessel drive off or other emergency shutdown occurrence, the lines are released from the mooring/crossover system. To allow for ease of reconnection of control lines to later reestablish control of the well, and to prevent damage to the umbilical lines, each umbilical 31, 32 can be provided with additional buoyancy (often termed midwater buoyancy) to facilitate umbilical disconnect in the event of a power failure on surface. By employing an umbilical 31, 32 having a buoyant section adjacent the lower ends of the umbilical 31, 32, for example, the emergency disconnect can be effected by releasing the quick disconnect 47, 55. Once released, the lower ends of the respective umbilical 31, 32, float up to a predetermined height above the seabed to avoid collision with other seabed equipment, leaving the subsea infrastructure secure.

Figure 5:
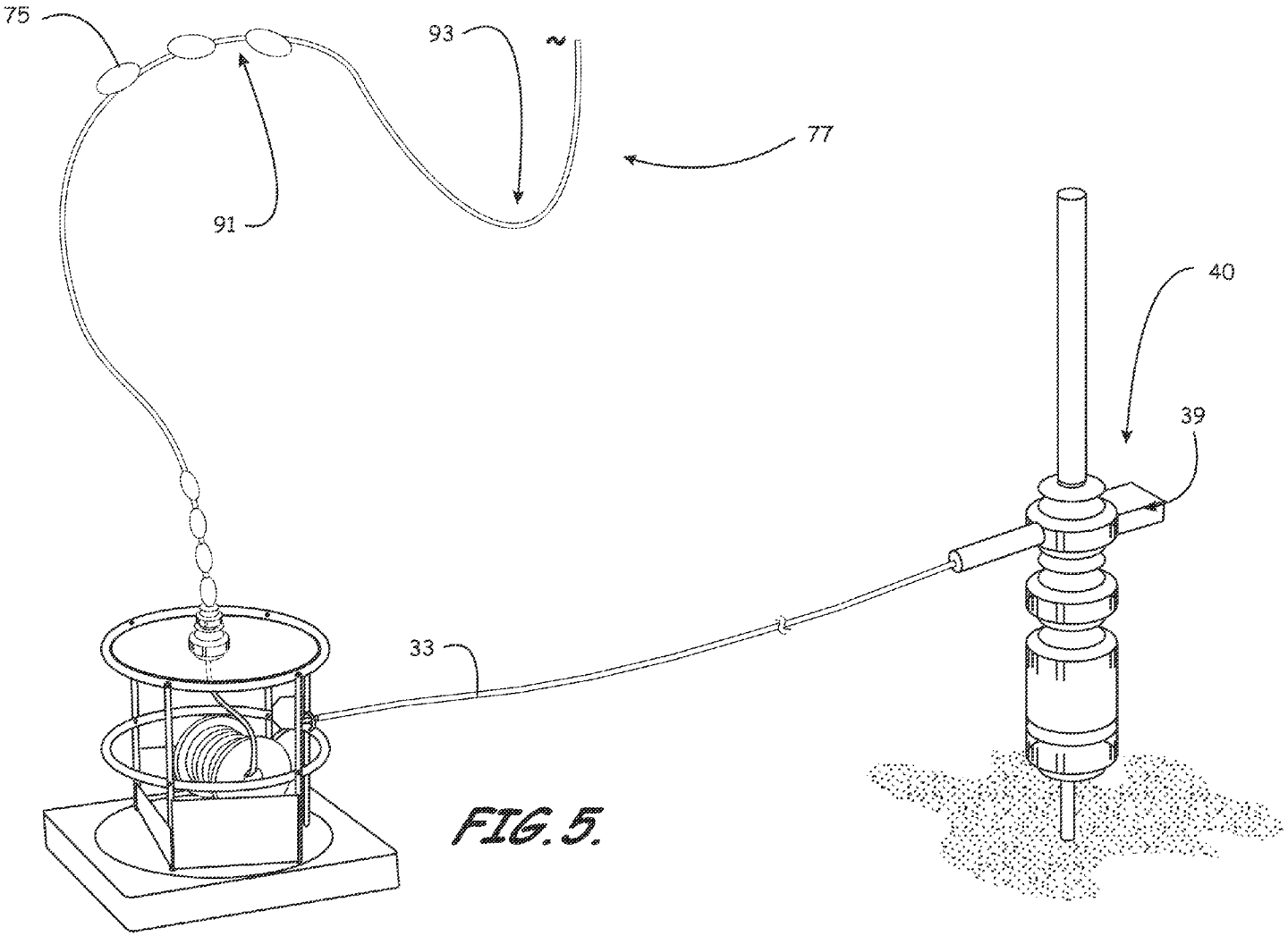
FIG. 5 is an environmental view of a tether management assembly according to an embodiment of the present invention.

Referring to FIG. 5, as will be understood by one of ordinary skill in the art, after deployment of the tether management assembly 35 at the appropriate depth, the tether management assembly 35, itself, further deploys the flying lead 33 for an ROV (not shown) to hook-up the deployed end to the EDP 39 of the wellhead 40. According to an exemplary procedure, after connecting end of the fly lead 33 to the EDP 39, the tether management assembly 35 is positioned adjacent to or landed on the seabed where it acts as a clump weight to maintain separation between the umbilical 31 and the wire line 37 and associated operations. Note, although the process is described as including landing the tether management assembly on the seabed, according to the exemplary configuration, the tether management assembly 35 and the flying lead spool assembly 45 are designed to be in "suspended" mode or supported mode by landing it on the sea bed with mud mat.

After reaching the seabed, an artificial compensation loop 77 is created in the umbilical line 31 utilizing set of buoyant modules 75 connected to or integral with a portion of the respective umbilical 31 to form an artificial compensation loop 77 which includes a buoyant loop portion 91 and a hanging loop portion 93 which is supported by both the buoyant modules 75 and the electrical-hydraulic umbilical winch and spool assembly 71 (see, e.g., FIG. 1). The hanging portion 93 is formed by paying out excess length of the umbilical line 31. The size and position of the buoyant loop portion 91 and the hanging loop portion 93 are determined by the amount of heave required for the local environment. This can be gathered via either a study or documentation of experience criteria.

Under typical conditions the amount of umbilical line 31 extending below the peak of the buoyant loop portion 91 is between approximately 25 m and 100 m in length, with a length of approximately between 40 m to 60 m being more typical, and approximately 50 m being even more typical. According to such configuration, vessel heave can be passively absorbed by the artificial compensation loop 77, negating a need for an expensive heave compensation unit/system on the umbilical winch and spool assembly 71.

Figure 6:
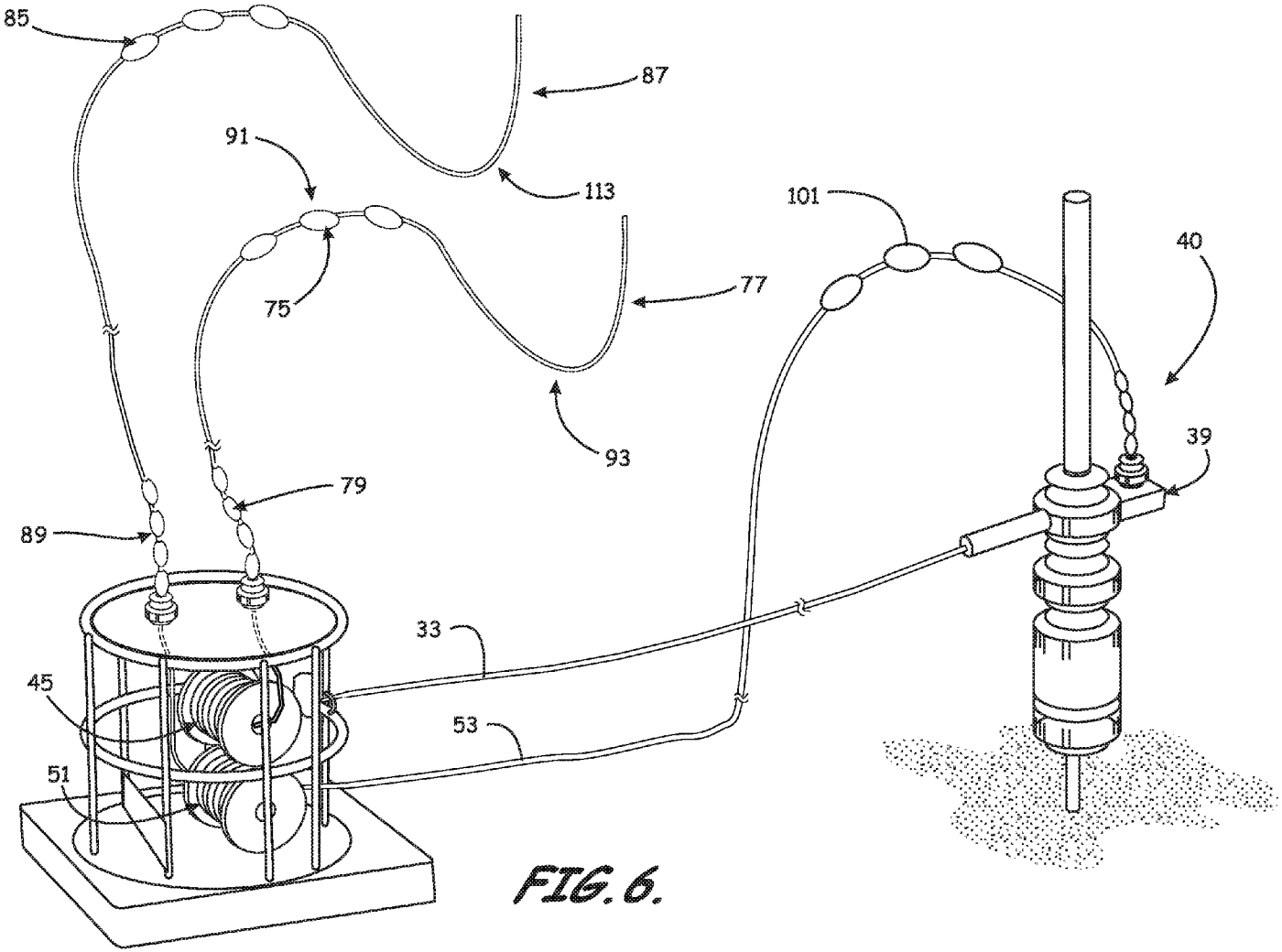
FIG. 6 is an environmental view of a tether management assembly according to an embodiment of the present invention.

As illustrated in FIG. 6, a similar process is performed when the tether management assembly 35 also includes annulus hose jumper spool assembly 51 when it is desired to deploy an annulus umbilical 32. In order to provide separation from the flying lead 33 and the tool wireline 37 and to align with the receptacle on the EDP 39, the annulus hose jumper 53 can include its own set of buoyancy modules 101. The buoyancy modules 101 can be positioned along a desired length of the annulus hose jumper 53 so that the portion of the annulus hose jumper 53 adjacent the subsea well 40 floats at a desired depth. Additionally, the location of the artificial compensation loop 77, 87, can be at different depths with the highest buoyant module 75 of buoyant loop portion 91 being lower than the lowest portion of hanging loop portion 113 and hanging loop portion 93 significantly higher than the top of bend restrictors 79, 89 to help prevent umbilical line entanglement. Further, the umbilical lines 31, 32 can be deployed over separate sides of the hull of the vessel 63 in order to maintain separation.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification.

What is claimed is:

1. A method for providing control and well kill capability during a subsea light well intervention, the method comprising the steps of:

connecting a sea-bound end of an umbilical line to a tether management assembly, the tether management assembly including a connector for operably coupling the sea-bound end of the umbilical line to a jumper, and a jumper spool assembly carrying the jumper;

running the umbilical line from an umbilical spool assembly located on a vessel, the umbilical spool assembly carrying the umbilical line;

connecting an end of the jumper to a well package connector located on a well package of a subsea well to include paying out a sufficient amount of the jumper to reach the well package connector located on the well package;

landing the tether management assembly at a seabed location substantially spaced apart from a location of the subsea well; and running a wireline from the vessel through a pressure control head connected to the well package of the subsea well, wherein the umbilical line at a location where the umbilical line extends from the vessel is substantially spaced apart from the wireline at a location where the wireline extends from the vessel.

2. A method as defined in claim 1, wherein the sea-bound end the umbilical line is connected to the tether management assembly prior to running the tether management assembly or landing the tether management assembly at the seabed location; and wherein the step of running the umbilical line from the umbilical spool assembly and landing the tether management assembly are performed together, the umbilical spool assembly carrying weight of both the tether management assembly and deployed portion of the umbilical line.

3. A method as defined in claim 1, wherein the umbilical spool assembly located on the vessel is carried by a skid-mounted deployment assembly, mounted on a single skid to reduce mobilization and installation time; and wherein the umbilical spool assembly is substantially spaced apart from a winch performing the step of running a wireline work tool on the wireline through the pressure control head.

4. A method as defined in claim 1, wherein the umbilical spool assembly is configured to deploy and at least partially support the combined weight of the umbilical line and the tether management assembly; and wherein the umbilical line is substantially spaced apart from a wireline tool run from the vessel on the wireline to perform a light well intervention responsive to positioning the tether management assembly at a location spaced apart from the subsea well.

5. A method as defined in claim 1, wherein the umbilical line is an integrated electrical and hydraulic line;

wherein the jumper is a flying lead; and wherein the jumper spool assembly is a flying lead spool assembly carrying the flying lead.

6. A method as defined in claim 5, wherein the tether management assembly further includes a variable weight mud mat configured to stabilize the tether management assembly according to local environmental conditions.

7. A method as defined in claim 1, wherein a set of buoyant modules are connected to the umbilical line, each of the set of buoyant modules positioned adjacent to at least one other buoyant module of the set of buoyant modules, the set of buoyant modules at least substantially entirely supporting the weight of the portion of the umbilical line extending between the set of buoyant modules and the sea-bound end of the umbilical line connected to the tether management assembly when the tether management assembly is landed at the seabed location;

wherein the method further comprises the step of paying out additional umbilical line so that a substantial portion of the umbilical line sags below a water level of the set of buoyant modules to form a heave compensation loop; and wherein in response to the step of paying out additional umbilical line, the set of buoyant modules at least partially supports the weight of the portion of the umbilical line extending between the set of buoyant modules and the umbilical spool assembly and sagging substantially below the water level of the set of buoyant modules at its nominal level, the umbilical spool assembly supporting the portion of the weight of the sagging portion of the umbilical line not supported by the set of buoyant modules.

8. A method as defined in claim 7, wherein the heave compensation loop measures between approximately 25 m and 100 m.

9. A method as defined in claim 7, further comprising the step of:

identifying an anticipated amount of movement of a reference point on the vessel in relation to the set of buoyant modules to determine an amount of slack needed to compensate for heave; and wherein neither the umbilical spool assembly nor associated deployment assembly includes a heave compensator.

10. A method as defined in claim 1, wherein the umbilical line is a first umbilical line, wherein the jumper is a first jumper defining a flying lead, wherein the connector is a first connector, wherein the tether management assembly further includes a second connector for operably coupling the sea-bound end of a second umbilical line to an annulus jumper, the annulus jumper including a plurality of buoyancy modules, and a jumper spool assembly carrying the annulus jumper, the method further comprising the step of:

connecting an end of the annulus jumper to a second well package connector located on the well package of the subsea well, paying out a sufficient amount of the annulus jumper to reach the second well package connector located on the well package.

11. A method for providing control and well kill capability during a subsea light well intervention, the method comprising the steps of:

connecting a sea-bound end of an umbilical line to a tether management assembly, the tether management assembly including a connector for operably coupling a crossover line to the sea-bound end of the umbilical line, and including a flying lead spool assembly carrying a flying lead operably coupled with the crossover line;

running the umbilical line from an umbilical spool assembly located on a vessel, the umbilical spool assembly carrying the umbilical line;

connecting an end of the flying lead to an emergency disconnect package connector located on an emergency disconnect package of a subsea well, paying out a sufficient amount of the flying lead to reach the emergency disconnect package connector located on the emergency disconnect package utilizing a remote operated vehicle;

landing the tether management assembly at a seabed location substantially spaced apart from a location of the subsea well; and running a wireline from the vessel through a pressure control head connected to the emergency disconnect package of the subsea well, wherein the umbilical line at a location where the umbilical line extends from the vessel is substantially spaced apart from the wireline at a location where the wireline extends from the vessel.

12. A method as defined in claim 11, wherein a first set of buoyant modules are connected to the umbilical line, each of the first set of buoyant modules positioned adjacent to at least one other buoyant module of the first set of buoyant modules, the first set of buoyant modules at least substantially entirely supporting the weight of the portion of the umbilical line extending between the first set of buoyant modules and the sea-bound end of the umbilical line connected to the tether management assembly when the tether management assembly is landed at the seabed location, the method further comprising the steps of:

paying out an additional umbilical line so that a substantial portion of the umbilical line sags below a water level of a second set of buoyant modules to form a heave compensation loop; and responsive to the step of paying out additional umbilical line, the second set of buoyant modules at least partially supporting the weight of the portion of the additional umbilical line extending between the second set of buoyant modules and the a second umbilical spool assembly and sagging substantially below the water level of the second set of buoyant modules at its nominal level, the second umbilical spool assembly supporting the portion of the weight of the sagging portion of the additional umbilical line not supported by the second set of buoyant modules.

13. A method as defined in claim 11, wherein the umbilical line is a first umbilical line, wherein the connector is a first connector, wherein the emergency disconnect package connector is a first emergency disconnect package connector, wherein the tether management assembly further includes a second connector for operably coupling the sea-bound end of a second umbilical line to an annulus jumper operably coupled with a plurality of buoyancy modules, and a jumper spool assembly carrying the annulus jumper, the method further comprising the step of:

connecting an end of the annulus jumper to a second emergency disconnect package connector located on the emergency disconnect package of the subsea well to include paying out a sufficient amount of the annulus jumper to reach the second emergency disconnect package connector located on the emergency disconnect package.

14. A system for providing control and well kill capability during a subsea light well intervention, the system comprising:

a tether management assembly landed at a seabed location substantially spaced apart from a location of a subsea well, the tether management assembly comprising a connector for operably coupling a crossover line to a sea-bound end of an umbilical line, a flying lead operably coupled with the crossover line and adapted to connect to an emergency disconnect package of a well control package for the subsea well, and a flying lead spool assembly for deploying the flying lead;

an umbilical spool assembly located on a vessel, the umbilical spool assembly configured to deploy and support the weight of the umbilical line and the tether management assembly during deployment thereof when connected thereto;

the umbilical line extending between the tether management assembly landed at the seabed location and the umbilical spool located on the vessel; and a wireline extending from the vessel through a pressure control head connected to the emergency disconnect package of the well control package for the subsea well, wherein the umbilical line at a location where the umbilical line extends from the vessel is substantially spaced apart from the wireline at a location where the wireline extends from the vessel.

15. A system as defined in claim 14, further comprising:

a set of buoyant modules connected to a portion of the umbilical line to be used to form an artificial heave compensation loop, the artificial heave compensation loop being defined by a substantial portion of the umbilical line sagging below a water level of the set of buoyant modules; and wherein the set of buoyant modules are positioned to at least partially support the weight of the portion of the umbilical line extending between the set of buoyant modules and the umbilical spool assembly and sagging substantially below the water level of the set of buoyant modules when at its nominal level, the umbilical spool assembly supporting the portion of the weight of the sagging portion of the umbilical line not supported by the set of buoyant modules.

16. A system as defined in claim 15, wherein the heave compensation loop measures between approximately 25 m and 100 m.

17. A system as defined in claim 15, wherein the umbilical line is an integrated electrical and hydraulic line, and wherein the umbilical spool assembly does not include a heave compensator.

18. A system as defined in claim 14, wherein the tether management assembly further includes a variable weight mud mat configured to stabilize the tether management assembly according to local environmental conditions.

19. A system as defined in claim 14, wherein the umbilical line is a first umbilical line, wherein the connector is a first connector, wherein the system further comprises a second umbilical line, wherein the tether management assembly further includes an annulus jumper, a second connector for operably coupling the sea-bound end of the second umbilical line to the annulus jumper operably coupled with a plurality of buoyancy modules and having an end adapted to connect to the emergency disconnect package, and a jumper spool assembly carrying the annulus jumper.

20. A system as defined in claim 14, wherein the umbilical spool assembly located on the vessel is carried by a skid-mounted deployment assembly, mounted on a single skid to reduce mobilization and installation time;

wherein the umbilical spool assembly is configured to deploy and at least partially support the combined weight of the umbilical line and the tether management assembly; and wherein the umbilical line is substantially spaced apart from a wireline tool run on the wireline from the vessel to perform a light well intervention.

21. A system for providing control and well kill capability during a subsea light well intervention, the system comprising:

a tether management assembly landed at a seabed location substantially spaced apart from a location of a subsea well, the tether management assembly comprising a jumper adapted to connect to a well control package connector located on a well control package for the subsea well, a jumper spool assembly for deploying the jumper, and a connector for operably coupling a seabound end of an umbilical line to the jumper;

an umbilical spool assembly located on a vessel and including an umbilical spool, the umbilical spool assembly configured to deploy the umbilical line;

the umbilical line configured to connect between the tether management assembly when landed at the seabed location and the umbilical spool when located on the vessel; and a wireline extending from the vessel through a pressure control head connected to the well control package for the subsea well, wherein the umbilical line at a location where the umbilical line extends from the vessel is substantially spaced apart from the wireline at a location where the wireline extends from the vessel.

22. A system as defined in claim 21, further comprising:

a set of buoyant modules connected to a portion of the umbilical line to be used to form an artificial heave compensation loop, the artificial heave compensation loop being defined by a substantial portion of the umbilical line sagging below a water level of the set of buoyant modules when operationally deployed with the umbilical line; and wherein the set of buoyant modules are positioned to at least partially support the weight of the portion of the umbilical line extending between the set of buoyant modules and the umbilical spool assembly and sagging substantially below the water level of the set of buoyant modules when at its nominal level, the umbilical spool assembly supporting the portion of the weight of the sagging portion of the umbilical line not supported by the set of buoyant modules.

* * * * *